US005593338A

United States Patent [19]

Itoh et al.

[11] Patent Number: 5,593,338

[45] Date of Patent: Jan. 14, 1997

[54] SPINNER AND ADAPTER FOR TOY TOPS AND COMBINATION OF SPINNER AND TOY TOP

[75] Inventors: Keisuke Itoh; Minoru Sawada, both of Tokyo, Japan

[73] Assignee: Kabushiki Kaisha Bandai, Japan

[21] Appl. No.: 348,465

[22] Filed: Dec. 2, 1994

[30] Foreign Application Priority Data

Dec. 6, 1993 [JP] Japan ..... 5-339752
Jan. 24, 1994 [JP] Japan ..... 6-023120

[51] Int. Cl.[6] ..... A63H 1/06; A63H 27/127

[52] U.S. Cl. ..... 446/259; 446/38; 446/262

[58] Field of Search ..... 446/37, 38, 39, 446/45, 233, 237, 238, 256, 257, 258, 259, 260, 261, 262, 263, 264, 429, 430, 462

[56] References Cited

U.S. PATENT DOCUMENTS

| | | | |
|---|---|---|---|
| 1,168,269 | 1/1916 | Allen | 446/237 |
| 1,403,200 | 1/1922 | Sandstrom . | |
| 1,448,724 | 3/1923 | Bujger | 446/237 |
| 1,858,639 | 5/1932 | Oram | 446/257 X |
| 2,619,769 | 12/1952 | Gallagher . | |
| 2,839,869 | 6/1958 | Lopez | 446/257 X |
| 3,452,470 | 7/1969 | Wohlstrom | 446/263 X |
| 3,570,467 | 3/1971 | Belokin, Jr. | 446/38 X |
| 3,645,037 | 2/1972 | Baginski et al. | 446/258 X |
| 4,130,963 | 12/1978 | Ohashi | 446/463 |
| 4,781,642 | 11/1988 | Stanzel | 446/38 |
| 5,199,410 | 4/1993 | Cheng . | |

FOREIGN PATENT DOCUMENTS

| | | | |
|---|---|---|---|
| 0057552 | 8/1982 | European Pat. Off. . | |
| 1195212 | 6/1965 | Germany | 446/37 |
| 1578682 | 8/1971 | Germany . | |
| 1181333 | 2/1970 | United Kingdom . | |
| 1255715 | 12/1971 | United Kingdom | 446/233 |
| 1544762 | 4/1979 | United Kingdom . | |
| 2109694 | 6/1983 | United Kingdom | 446/463 |
| 2212070 | 7/1989 | United Kingdom . | |

*Primary Examiner*—Robert A. Hafer
*Assistant Examiner*—D. Neal Muir
*Attorney, Agent, or Firm*—R. Gale Rhodes, Jr.

[57] ABSTRACT

Toy top spinner which uses a toy top body as a spinning wheel to accelerate the spinning speed of the spinning wheel easily, and an adapter used with the spinner to spin toy tops having slightly different diameters. The spinner has its body equipped with a brake in addition to the spinning wheel. The rotor is formed with hook means. Between the spinning wheel and the rotor, there is interposed a gear train which is equipped with an idle gear. The brake includes a braking member and a braked member mounted on the axle of the rotor. The adapter device can be removably mounted on the rotor and has its body formed with a hook member inside of the hook means of the rotor.

4 Claims, 5 Drawing Sheets

SPINNER AND ADAPTER FOR TOY TOPS AND COMBINATION OF SPINNER AND TOY TOP

BACKGROUND OF THE INVENTION

1. Field of the Invention

The present invention relates to a spinner for spinning a toy top, an adapter for use with the spinner and the combination of a spinner and toy top.

2. Description of the Related Art

A toy top known to the prior art includes a driver provided with a spring which is wound to accumulate force which is imparted to the toy top to cause the top to spin. Such toy top spinner has not been found to be sufficiently satisfactory because the mechanism for winding the spring is undesirably complicated and it experiences so much mechanical loss in imparting spinning action to the toy top that it cannot impart the desired number of revolutions to the top for the desired spinning action.

Accordingly, there is a need in the art for a spinner providing a greater number of revolutions to a toy top, the combination thereof and for an adapter which permits a spinner to spin relatively larger and smaller tops.

SUMMARY OF THE INVENTION

It is the object of the present invention to satisfy the foregoing needs in the art.

Apparatus embodying the present invention and satisfying the foregoing needs may include a spinner provided with a rotor to which a toy top is removably mounted. The spinner includes a spinning wheel which upon being rotated imparts rotation to the rotor, and thereby to the toy top, through an intermediate gear train including a pinion and an idle gear mounted movably in a slot. The pinion is connected to the rotor and the idle gear is connected to the spinning wheel. Upon the rotor and toy top spinning at a higher rate than the spinning wheel, the pinion repels the idle gear which moves along the slot away from and out of engagement with the pinion whereupon the spinning wheel and idle gear impart no braking action to the rotor and thereby to the toy top after which the toy top accumulates rotating energy and acts as the spinning wheel for the rotor. Upon the spinner and toy top being inverted and a braking member provided on the spinner operated, rotation of the rotor is stopped and the toy top is released from the rotor, falls to a playing surface and spins until the rotational energy accumulated In the toy top dissipates. The present invention further includes the combination of such spinner and toy top and an adapter for being mounted to the spinner to permit the spinner to spin relatively larger and smaller tops.

BRIEF DESCRIPTION OF THE DRAWINGS

FIG. 5 is reversed in direction from FIG. 4;

DESCRIPTION OF THE PREFERRED EMBODIMENTS

Figure 1:
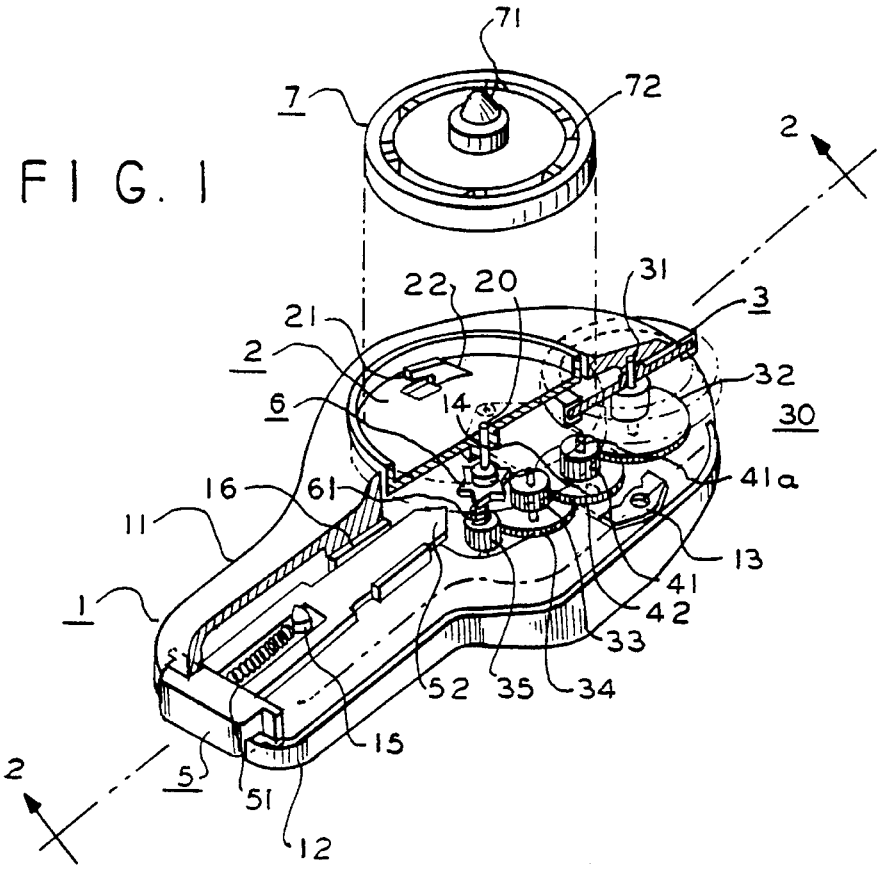
FIG. 1 is a cut-away perspective view showing an essential portion of a spinner of a toy top according to one embodiment of the present invention.

Here will be described one embodiment of the present invention with reference to the accompanying drawings. In FIG. 1, reference numeral 1 generally designates a spinner for spinning the toy top 7. The spinner 1 is molded of a synthetic resin into halved casings 11 and 12. The spinner 1 is provided with a bearing portion, in which is rotatably mounted the axle 20 of a rotor 2. Spinner means is provided with a spinning wheel 3 for spinning the rotor 2. Between the spinning wheel 3 and the axle 20 of the rotor 2, there is interposed an accelerating gear train 30 which includes an idle gear 42 formed integrally with a pinion 41.

Figure 2:
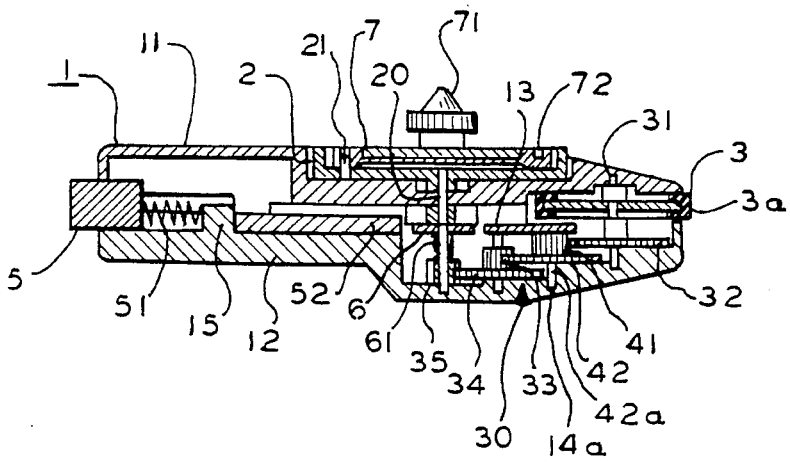
FIG. 2 is a cut-away side elevation showing an essential portion of the toy top spinner of the present invention and is taken generally along the line 1—1 in FIG. 1 the direction of the arrows but with the toy top mounted on the spinner.

On the axle 31 of the aforementioned spinning wheel 3, there is fixed a spur gear 32. The casing 12 is equipped in the vicinity of the spur gear 32 with an intermediate bearing plate 13 (FIGS. 1 and 2), which is provided with an arcuate slot 14 into which the upwardly extending axle 41*a* of the pinion 41 is movably fitted. The intermediate bearing plate 13 further bears a pinion 33 and a gear 34 formed integrally with the pinion 33. The downwardly extending axle 42*a* of the idle gear 42 is fitted movably into an arcuate slot 14*a* formed in the body of the spinner 1 opposite the arcuate slot into which the axle of the pinion 41 is movably fitted. This permits the idle gear 42 to be a movable gear and permits the idle gear to move back and forth along the slot 14*a* into which its axle 41*a* is fitted and into and out of engagement with the pinion 33. The gear 34 is in meshing engagement with a pinion 35 which is fitted on the axle 20 of the rotor 2. The pinion 41 always meshes with the spur gear 32 but the idle gear 42 moves into and out of engagement with the pinion 33 as the idle gear 42 moves back and forth along the slot into which its axle is fitted.

The casing 12 is formed with a support projection 15 and a guide member 16. A return spring 51 is connected between the projection 15 and a braking member 5, which can be operated along the guide member 16 from the outside or externally of the spinner 1.

The axle 20 is equipped, at its position opposed to the inner end or face of the braking member 5, with a push spring 61 for establishing a desired frictional force. At the position of the axle 20, there is rotatably fitted a braked member 6 which has corrugations on its periphery.

The aforementioned rotor 2 is mounted on the upper portion of the casing 11. This rotor 2 is formed into such a disc shape to facilitate the removable mounting thereto of a toy top body 7 removably. The rotor 2 is further formed on its circumference with a plurality of hook means 21 having slopes 22 for engaging with the top body 7 in individually predetermined directions of rotation. On the other hand, the top body 7 is formed generally into a disc shape and equipped at its center with a generally conical axle member 71 on which the top spins. The top body 7 is formed on its circumferential edge portion with engagement means for engaging with the hook means 21 of the aforementioned rotor 2; the engaging means 72 have openings complementary to and for receiving the hook means 21 provided on the rotor 2.

Figure 3:
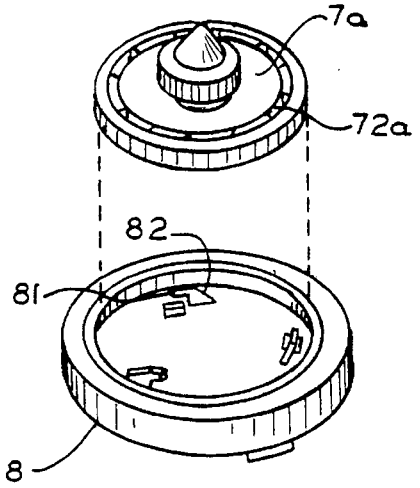
FIG. 3 is an exploded perspective view showing a toy top and an adapter device for the toy top spinner of the present invention.

FIG. 3 shows an adapter device 8 which may be used to mount a top body 7*a*, smaller in diameter than the foregoing top body 7, on the spinner 1. In this case, the adapter device 8 is formed generally into a disc shape so that it can be removably mounted in the rotor 2 of the spinner by suitable mounting means such as screws or by forming pawl members to be retained by the hook means 21 (not shown). The adapter device 8 is formed with a plurality of hook members 81 provided with slopes 82 for engaging in predetermined directions of rotation with engagement means 72*a* formed on the circumferential edge portion of the top body 7*a* in the same manner as the engagement means 72 on the top 7 engage the hook means 21 provided on the rotor 2.

According to the embodiment described above, when the top body 7 is placed for spinning on the rotor 2 of the spinner body 1, its engagement means 72 are caught or engaged in a predetermined direction of rotation by the hook means 21 of the rotor 2. When the spinning wheel 3 is then rotated, the rotor 2 is driven through the spur gear 32, the pinion 41, the idle gear 42, the pinion 33, the gear 34 and the pinion 35 of the gear train 30 so that the top body 7 is spun together with the rotor 2; the rotation imparted to the idle gear 42 causes it to move along the slot into which its axle is fitted and engage and mesh with the pinion 33 if the idle gear 42 is not in engagement with the pinion 31 when the spinning wheel 3 is spun.

If the spinning speed of the rotor 2 exceeds that of the spinning wheel 3, the idle gear 4 is repelled by the faster turning pinion 33 (in engagement with the rotor 2 through the gear 34 and the pinion 35) and the idle gear 42 moves along its slot away from and out of engagement with the pinion 33 and moves away to turn idle so that no braking action is imparted to the rotor 2 (and hence the top 7 mounted to the rotor) by the gear train 30 particularly the idle gear 42 and slower turning spinning wheel 3. It will be understood that upon the idle gear 42 moving out of engagement with the pinion 34 the idle gear isolates the axle 20 of the rotor 2 from the spinning wheel 3. Then, the spinning force of the spinning rotor 2 is effectively transmitted to the top body 7 so that the top body 7 can be easily spun at a high speed or rate of rotation. As a result of this rotation, the top body 7 then acts as the spinning wheel of the spinner body 1 to accumulate the spinning energy.

When the top body 7 reaches a desired spinning speed, the spinner 1 and top 7 are inverted, turned over, and the braking member 5 is pressed inwardly. Then, the end portion 52 of the braking member 5 comes into contact with the braked member 6 and the rotor 2 is abruptly braked or stopped from rotating. By this abrupt stopping of the rotor 2, the hook means 21 and the engagement means 72 are instantly disengaged from each other by the inertial action of the top body 7 so that the top body 7 is released along the slopes 22 of the hook means 21 of the rotor 2. After release, the top body 7 leaves the spinner body 1, while spinning, until it falls onto a playing field or surface after which the top body 7 continues spinning at a high speed until the accumulated spinning energy of the toy top is dissipated.

If the adapter device 8 is mounted on the rotor 2 of the aforementioned spinner body 1, the hook members 81 can be positioned inside of the hook means 21 of the rotor 2. As a result, the engagement means 72*a* of the smaller top body 7*a* can be brought into engagement with the hook members 81 and spun, as described above with regard to the top 7, by the spinning motions of the spinning wheel 3.

In the aforementioned construction, the hook means 21 are formed into the hook shape, and the engagement means 72 to engage the former are formed into the groove or hole shape. However, both of them may be formed into hook shapes mating each other. Alternatively, the engagement means 72 may be formed into a hook shape and the hook means 21 may be formed as grooves or holes to removably engage the engagement means 72.

The spinning wheel 3 may have its circumference covered with a rubber member 3*a*, or it may be integrally formed of a material such as hard rubber. Moreover, the braked member 6 is molded of a synthetic resin and provided with the integrally formed corrugated circumference for enhancing the braking effect. However, the braked member 6 should not be limited to such construction but may be formed of metal. Alternatively, the spinning wheel 3 may be modified to push the rotor 2 or the axle 20 so as to achieve the braking effect.

Another embodiment of the top spinner according to the present invention will be described with reference to FIGS. 4 to 11.

Figure 4:
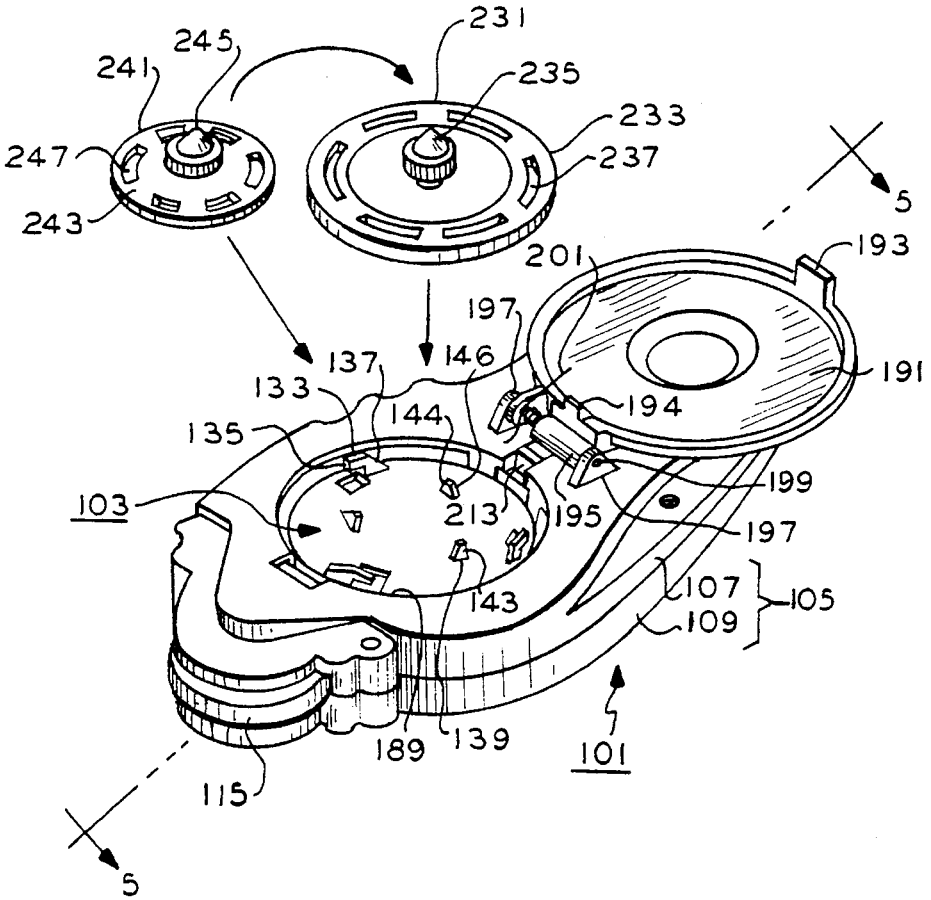
FIG. 4 is a perspective view showing the entirety of a toy top spinner according to another embodiment of the present invention.
Figure 5:
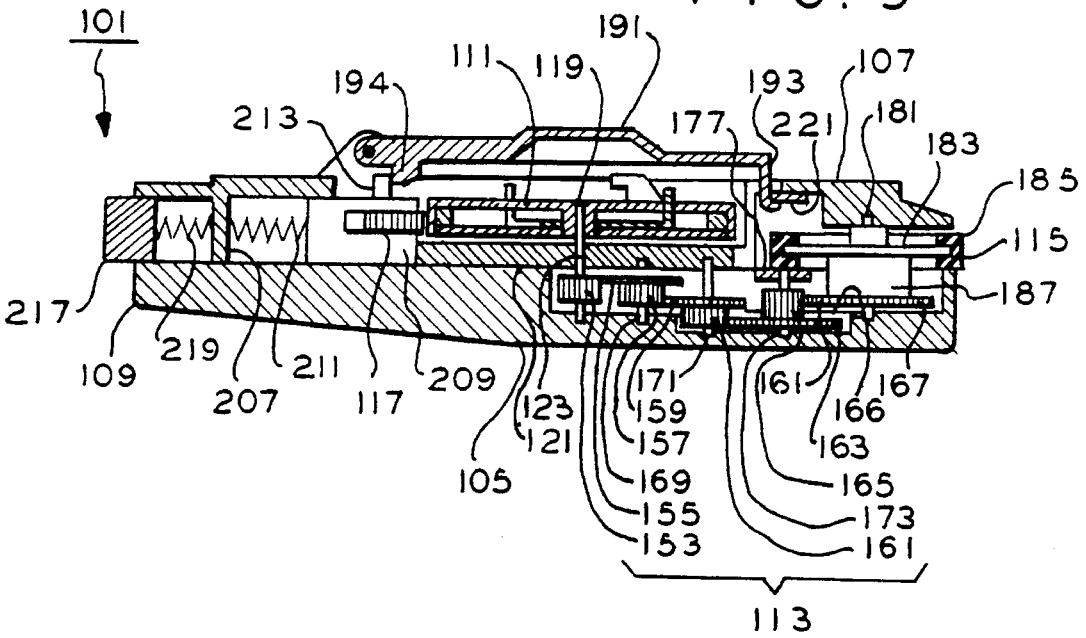
FIG. 5 is a cut-away side elevation showing an essential portion of the toy top spinner according to the latter embodiment of the present invention and taken generally along the line 5—5 in FIG. 4 in the direction of the arrows but with the toy top and adapter mounted to the spinner.

A spinner body 101 is constructed, as shown in FIGS. 4 and 5, to include a driver 103 for driving a later-described toy top rotationally and a casing 105 mounting the driver 103 therein. The casing 105 is molded of a synthetic resin and is vertically halved into an upper casing 107 and a lower casing 109 which are joined by screws.

The driver 103 is constructed to include: a rotor 111 for carrying the toy top; a gear train 113 for transmitting the power to the rotor 111; a spinning wheel 115 for transmitting the power to the gear train 113; and a braking wheel 117 for braking the rotor 111.

Figure 6:
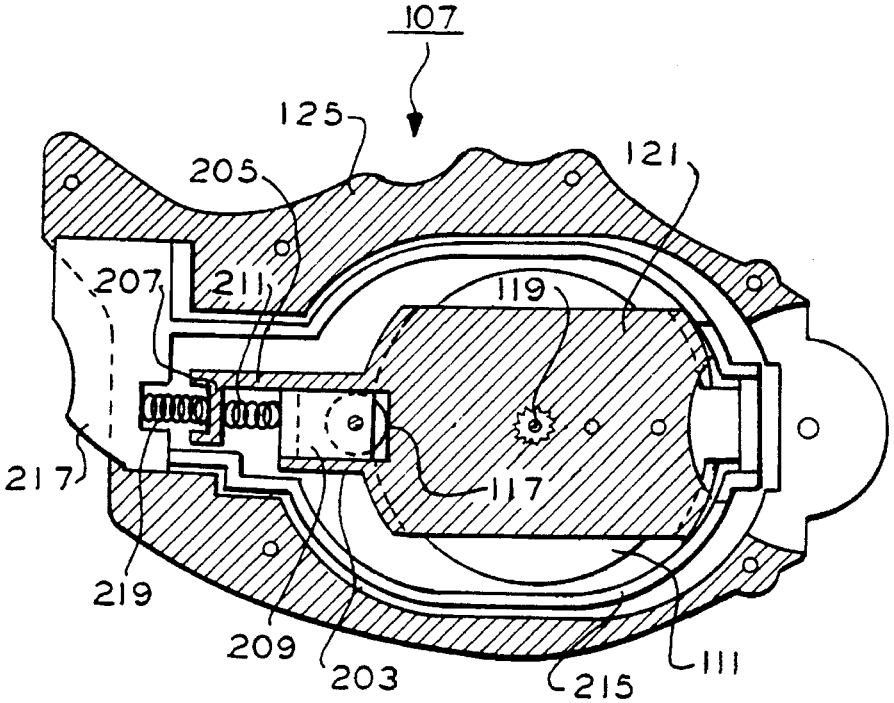
FIG. 6 is a top plan view showing the latter embodiment of the present invention, as taken from the inner side of an upper casing.

The driver 103 will be described in more detail. The rotor 111 is mounted, as shown in FIGS. 5 and 6, in the upper casing 107 and has its axle 119 fitted rotatably in a bearing hole 123 which is formed in an intermediate wall 121. This intermediate wall 121 is joined with the upper casing 107 so as to be flush with the joint face 125 of the upper casing 107.

Figure 8:
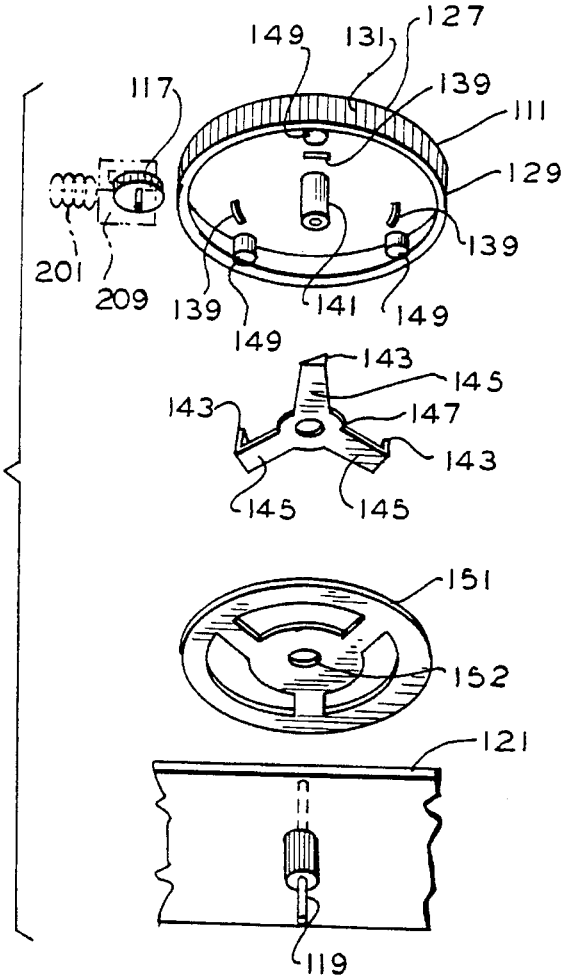
FIG. 8 is a perspective view showing an essential portion of a rotor according to the latter embodiment of the present invention.

The rotor 111 is constructed, as shown in FIG. 8, to include a rotary disc 127 and a side wall 129 formed on the circumferential edge of the rotary disc 127. The side wall 129 has its outer circumference 131 milled to increase the frictional resistance. For this frictional resistance, the outer circumference of the rotary disc 127 may be covered with a band of rubber. The rotary disc 127 is integrally formed, as shown in FIG. 4, with three retaining hooks 133 which are equidistantly arranged on a common circumference. Each of these retaining hooks 133 is formed with a retaining projection 135 in the direction of rotation and with a taper portion 137 in the opposite direction. Additionally, the rotary disc 127 is formed with three through holes 139 (as best seen in FIG. 8) which are equidistantly arranged on a circumference smaller than the foregoing one.

The rotary disc 127 is equipped at the center of its lower face with a bearing boss 141 (FIG. 8) for fixing the axle 119 therein. On this bearing boss 141, there is slidably fitted a small plate 147 which is equipped with arms 145 extending in three directions. Each of these arms 145 is equipped at its leading end with a retaining pawl 143 to protrude through the corresponding one of the aforementioned through holes 139. Referring to FIG. 4, the retaining pawl 143 is formed into such a triangular shape which has a retaining edge 144 in the direction of rotation and a taper portion 146 in the opposite direction. However, the retaining pawl 143 may be formed into the same shape as that of the retaining hook 133.

In the inner circumferential edge of the lower portion of the side wall 129, there is mounted an elastic disc 151 which is fixed on three bosses 149 formed on the lower face of the rotary disc 127. The elastic disc 151 thus formed is formed with a hole 153 for receiving the aforementioned bearing boss 141 while pushing the aforementioned small plate 147 toward the rotary disc 127. Alternatively, the elastic disc 151 may be dispensed with, if the arms 145 themselves are made elastic and are fixed on the bearing boss 141 or the back of the rotary disc 127.

Figure 7:
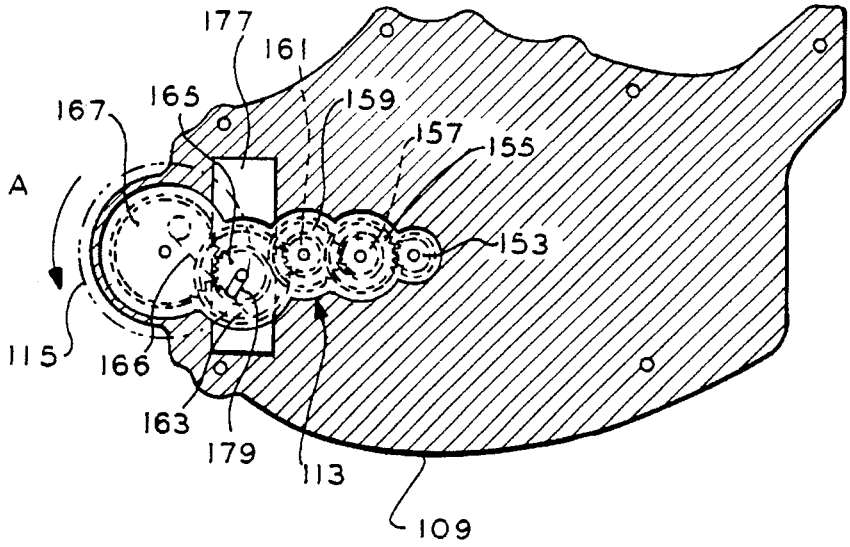
FIG. 7 is a top plan view showing the latter embodiment of the present invention, as taken from the inner side of a lower casing.

The gear train 113 is disposed in the lower casing 107, as shown in FIGS. 5 and 7. This gear train 113 is constructed to include: a final gear 153 ;a spur gear 155 meshing with the final gear 153 at all times; a pinion 157 integrated with the spur gear 155; a spur gear 159 meshing with the pinion 157 at all times; a pinion 161 integrated with the spur gear 159; an idle gear 163 brought into and out of meshing engagement with the pinion 161; a planetary gear 165 integrated with the idle gear 163; and a spur gear 167 meshing with the planetary gear 165 at all times.

The final gear 153 is fixed on the aforementioned axle 119. The spur gear 155 and the pinion 157 are fixed on a second intermediate shaft which is rotatably borne by the intermediate wall 121 and the lower casing 109, and the spur gear 159 and the pinion 161 are also fixed on a first intermediate shaft 171 which is rotatably borne by the intermediate wall 121 and the lower casing 109. The idle gear 163 and the planetary gear 165 are fixed on a moving shaft 173. This moving shaft 173 has its one end fitted slidably and rotatably in an arcuate slot 179 which is formed in a bearing plate 177 (FIG. 7) mounted in the lower casing 109 and its other end fitted slidably and rotatably in an arcuate slot 175 (not shown in FIG. 7 but residing below the arcuate slot 179) which is formed in the lower casing 109. These slots 175 and 179 are formed into arcuate shapes on the axis of the spur gear 167. The planetary gear 165 is urged toward the pinion 161 by an elastic member 166 (FIG. 5) which is mounted in the lower portion of the lower casing 109. The spur gear 167 is fixed on a center shaft 181 which is rotatably borne by the upper casing 107 and the lower casing 109.

On the center shaft 181, there is fixed the spinning wheel 115. This spinning wheel 115 includes a spinning disc 183 fixed on the center shaft 181 and a band of rubber 185 covering the circumferential edge or outer peripheral portion of the spinning disc 183. The spinning disc 183 is integrated through a rotary drum 187 with the spur gear 167. The spinning wheel 115 thus constructed is mounted to have its outer peripheral portion protrude outwardly of the casing through an opening formed in the upper casing 107.

The upper casing 107 is formed, at a position opposed to the aforementioned rotor 111 (FIGS. 5 and 8), with an opening 189 (FIG. 4) having a diameter slightly larger than that of the rotor 111. This opening 189 is covered with a cover 191 (FIG. 5). This cover 191 is equipped with a retaining pawl 193 (FIG. 4) at its front end and with a bearing boss 195 at its rear end. This bearing boss 195 is rotatably borne through a pin 199 by a pair of triangular bearing projections 197 which are formed on the upper face of the upper casing 107. On the pin 199, there is wound a torsion spring 201. This torsion spring 201 has its one end abutting against the upper face of the upper casing 107 and its other end abutting against the bottom face of the cover 191 so that it urges the cover 191 into the open position. Moreover, the bearing boss 195 is equipped with an engagement member 194 which takes in a lower position when the cover 191 is closed to cover the opening 189. The elastic member for urging the cover 191 into the open position may be made of a leaf spring, a coil spring or rubber in addition to the aforementioned torsion spring 201.

The upper casing 107 is formed therein, as shown in FIGS. 5 and 6, with a pair of guide walls 203 and 205 which are extended backward from the intermediate wall 121. Of these, one guide wall 205 is further extended backward to have a spring receiving wall 207 integrated with its rear portion. Between the paired guide walls 203 and 205, there is fitted a slide member 209 having a generally C-shaped section, which is allowed to slide back and forth. This slide member 209 carries the aforementioned braking wheel 117 rotatably. Between this slide member 209 and the spring receiving wall 207, there is mounted a coil spring 211, which urges the braking wheel 117 to contact with the outer circumference 131 of the rotor 111.

The slide member 209 is equipped on its upper face with an engagement projection 213 which comes into engagement with the aforementioned engagement member 194 to slide the slide member 209 in the direction away from the rotor 111 against the elasticity of the coil spring 211 thereby to disengage the braking wheel 117 from the outer circumference 131 of the rotor 111. The means for braking the rotor 111 should not be limited to the braking wheel 117 but can be exemplified by such a leaf member as is urged to contact directly with the outer circumference 121 of the rotor 111 by an elastic member.

In the upper casing 107, there is mounted an annular control member 215 which encloses the rotor 111. This control member 215 is formed at its rear end with a push knob 217. This push knob 217 is urged backward by a coil spring 219 which is mounted between the push knob 217 and the aforementioned spring receiving wall 207. The front end of the control member 215 is formed with a retaining member 221 for retaining the retaining pawl 193 of the aforementioned cover 191.

Reference numeral 231 (FIG. 4) designates the toy top, which is constructed to include a rotary disc 233 and a conical axle 235 fixed on the center of the lower face of the rotary disc 233. This rotary disc 233 is formed in its circumference (or outer peripheral portion) with a plurality of slots 237 for receiving the retaining hooks 133 formed on the rotary disc. Numeral 241 designates a toy top which is made smaller than the toy top 231 and constructed to include a rotary disc 243 and a conical axle 245 fixed on the center of the lower face of the rotary disc 243. This rotary disc 243 is formed in its circumference or outer peripheral portion with a plurality of slots 247 for receiving the retaining pawls 143 formed on the small plate 147 and extending through the slots 139 formed in the rotary disc 127. The toy top 231 may be formed in the rotary disc 233 with a circular recess, in which the toy top 241 may be fitted.

Since the top spinner according to the later embodiment of the present invention is given the construction described above, the engagement member 194 of the cover 191 exerts no action, while the cover 191 is open, upon the engagement projection 213. As a result, the braking wheel 117 is pushed to contact with the outer circumference 131 of the rotor 111 by the coil spring 211 so that the rotor 111 is braked.

While the cover 131 is open, the retaining hooks 133 of the rotor 111 are inserted into the slots 237 of the rotary disc 233 of the top 231 to bring the upper face of the rotary disc 233 into abutment against the upper face of the rotary disc 127. When the rotary disc 233 is rotated in the clockwise direction of rotation relative to the rotor 111, its lower face is retained by the retaining projections 135 of the retaining hooks 133.

Figure 11:
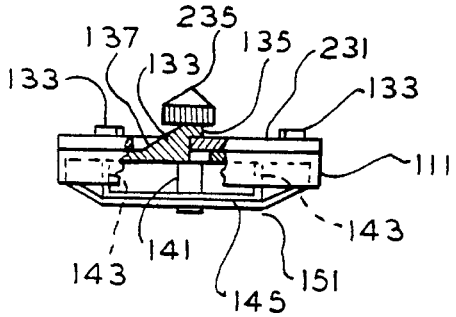
FIG. 11 is a cut-away side elevation showing a toy top and an essential portion of a rotor according to the latter embodiment of the present invention.

The retaining pawls 143 protruding through the through holes 139 of the rotary disc 127 are pushed by the upper face of the rotary disc 233, as shown in FIG. 11, so that they are retracted into the rotor 111 against the elasticity of the elastic disc 151. The rotary disc 233 of the toy top 231 has its lower face forced to contact with the retaining projections 135 of the retaining hooks 133, because it is pushed by the retaining pawls 143, so that it is firmly fastened to the rotor 111.

When the cover 191 is closed to cover the opening 189 against the elasticity of the torsion spring 201 (FIG. 5), the engagement member 194 pushes the engagement projection 213 against the elasticity of the spring 211 (FIG. 6) to disengage the braking wheel 117 from the outer circumference 131 of the rotor 111. The rotor 111 can rotate, when the cover 191 covers the opening 189, but is not rotatable while the opening 189 is uncovered. As a result, a remarkable safety is achieved because the finger or the like of the player is not engageable by the rotor 111 and injury is prevented. Moreover, the retaining pawl 193 of the cover 191 is retained by the retaining member 221 of the control member 215 so that the cover 191 is held in its closed position.

Figure 9:
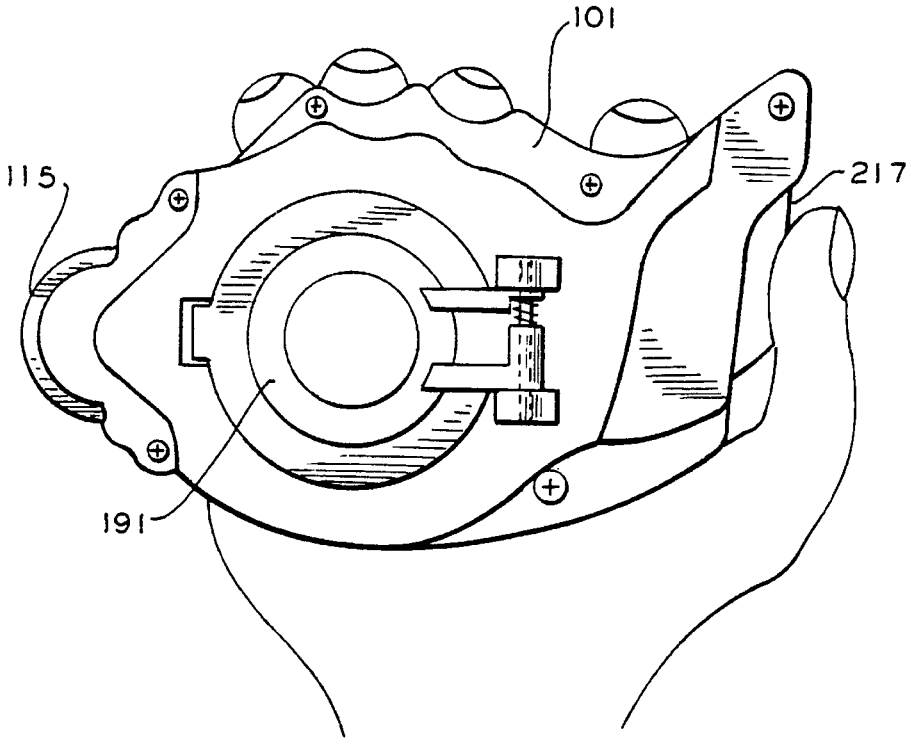
FIG. 9 is a top plan view showing the use of the latter embodiment.
Figure 10:
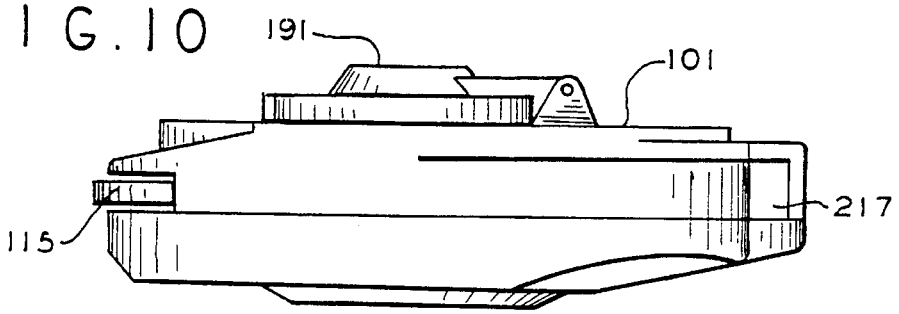
FIG. 10 is a side elevation showing a spinner of a toy top according to the latter embodiment of the present invention.

The spinner 101 is held by one hand of the player, as shown in FIG. 9, and the spinning wheel 115 is turned in one direction (i.e., in the direction A, as shown in FIG. 7) by causing it to contact with the surface of a desk or wall. This rotation is accelerated and transmitted to the rotor 111 through the spur gear 167 (FIG. 5), the planetary gear 165, the idle gear 163, the pinion 161, the spur gear 159, the pinion 157, the spur gear 155, the final gear 153 and the axle 119.

After the spinning wheel 115 has been repeatedly turned to spin the rotor 111 sufficiently, the spinner 101 is inverted, the push knob 217 is pushed by the thumb of the player against the elasticity of the coil spring 219. The retaining member 221 of the control member 215 (FIG. 6) is depressed forward to release the retaining pawl 193 (FIG. 5) of the cover 191 from its retained state. As a result, the cover 191 is instantly opened by the elasticity of the torsion spring 201. Simultaneously with this, the engagement member 194 moves upward to release the engagement projection 213. Then, the braking wheel 117 is urged into contact with the outer circumference 131 of the rotor 111 by the coil spring 211.

The rotor 111 abruptly decelerates, but the toy top 231 is spun as it is by the inertial force of the rotary disc 233. When the rotary disc 233 has its lower face disengaged from the retaining projections 135 of the retaining hooks 133 to ride on the taper portions 137 of the retaining hooks 133, then the top 231 falls and spins on its axle 235. Since the retaining pawls 143 are urged to contact with the upper face of the rotary disc 233, they push the rotary disc 233 downward simultaneously as the rotary disc 233 comes out of engagement with the retaining hooks 133, to accelerate the falling speed of the toy top 231.

The abrupt deceleration of the rotor 111 drops the rotating speeds of the final gear 153, the spur gear 155, the pinion 157, the spur gear 159 and the pinion 161. The idle gear 163 meshing with the pinion 161 is rotated at a high speed by the inertial force of the spinning wheel 115 but is snapped away from the pinion 161, as this pinion 161 is abruptly decelerated, so that it is prevented from braking.

The toy top 241, alternative to the toy top 231, can be mounted on the rotor 111 by inserting the retaining pawls 143 protruded from the rotor 111 into the slots 247 of the rotary disc 243 to bring the upper face of the rotary disc 243 into contact with the upper face of the rotary disc 127. When the cover 191 is closed like before, its back face holds the axle 245 so that the retaining pawls 143 are held in the slots 247. If the retaining pawls 143 are given the same shape as that of the retaining hooks 133, the rotary disc 243 is firmly fixed by the retaining pawls 143. If the spinning wheel 115 is rotated and the cover 191 opened as described before, the toy top 241 falls down and spins on the axle 245.

According to the spinner for the toy top of the present invention, as has been described hereinbefore, the top can be directly spun through the gear train not by any spring means but by turning the spinning wheel, so that the rotational force of the spinning wheel can be effectively transmitted without any substantial loss to spin the toy top easily at a high speed. During this spinning action, the gear train is prevented from braking by the idling action of the idle gear if the rotating speeds of the rotor exceeds that of the spinning wheel. Due to this spinning motion, moreover, the top acts as the spinning wheel of the spinner so that its spinning energy is accumulated to continue the high-speed spinning motion of the top for a longer time than would occur were the gear train and spinning wheel to provide braking action to the rotor and toy top mounted removably to the rotor.

In the toy top spinner which is equipped with the braking member responding to the opening/closing actions of the cover to make the rotor non-rotatable when the cover is open and rotatable when the cover is closed, on the other hand, there can be achieved an effect that the player can safely enjoy without having his or her thumb or the like injured by the rotor.

If the rotor is equipped with the first engagement member for engaging with a larger toy top and the second engagement member for engaging with a smaller toy top such that the first engagement member is fixed on the rotor whereas the second engagement member can appear out of and disappear into the rotor, the larger top has its upper face pushing the second engagement member into the rotor even if it brought into engagement with the first engagement member. Thus, another effect is that the larger top can be brought into engagement with the first engagement member without any influence from the second engagement member.

Moreover, if the adapter device is mounted on the rotor of the spinner, the engagement means of the toy top having a smaller diameter can be brought into engagement with the hook members so that the smaller top can be spun by the spinning action of the spinner. As a result, the play of the toy top can be widened.

What is claimed is:

1. A spinner for a toy top, comprising:

(a) a body including a rotor having an axle, spinning means including a spinning wheel and braking means;

(b) hook means provided on said rotor for removably engaging the toy top to rotate the top in a predetermined direction of rotation;

(c) a gear train interposed between said spinning wheel and said axle for transmitting the rotation of said spinning wheel to said rotor and thereby to the toy top;

(d) said gear train including an idle gear for isolating the rotation of said axle from said spinning wheel;

(e) said braking means including a braking member provided with an end portion and adapted to be operated from outside the body;

(f) a braked member mounted on said axle which is opposed to said end portion of said braking member and engageable therewith upon operation of said braking means to stop rotation of said rotor and to release the top from the rotor for spinning; and (g) said hook means including a first engagement member for engaging a larger toy top, and a second engagement member for engaging a smaller toy top such that said first engagement member is fixed on said rotor whereas said second engagement member can appear out of and disappear into said rotor.

2. Combination toy top spinner and a toy top, comprising:

(a) a body including a rotor having an axle, spinning means including a spinning wheel and braking means;

(b) hook means provided on said rotor for removably engaging the toy top to rotate the top in a predetermined direction of rotation;

(c) a gear train interposed between said spinning wheel and said axle for transmitting the rotation of said spinning wheel to said rotor and thereby to the toy top;

(d) said gear train including an idle gear for isolating the rotation of said axle from said spinning wheel;

(e) said braking means including a braking member provided with an end portion and adapted to be operated from outside the body;

(f) a braked member mounted on said axle which is opposed to said end portion of said braking member and engageable therewith upon operation of said braking means to stop rotation of said rotor and release the top from the rotor for spinning;

(g) a top body of generally disc shape including a circumferential edge portion and provided with a generally conical axle at its central portion; and (h) engagement means formed on the circumferential edge portion of said top body for removably engaging said hook means provided on said rotor.

3. A spinner for a toy top, comprising:

(a) a spinner body including a casing and a driver mounted in said casing for driving said toy top rotationally, (b) said driver including a rotor, a spinning wheel including a peripheral portion protruding from the inside of said casing, and a gear train for transmitting rotation of said spanning wheel to said rotor;

(c) hook means formed on said rotor for removably engaging the toy top to said rotor to impart rotation to the top in a predetermined direction of rotation;

(d) said gear train includes an idle gear for transmitting the rotation of said spinning wheel to said rotor but not the rotation of said rotor to said spinning wheel;

(e) a braking member and an elastic member mounted in said casing, said braking member urged into contact with said rotor by an elastic member thereby to brake the rotation of said rotor;

(f) said casing provided with an opening for inserting the toy top therethrough to mount the toy top on said rotor and said casing including a cover and a second elastic member urging the cover into an open condition;

(g) a control member disposed at one side of said casing and having a retaining portion for retaining said cover in a closed position against the elasticity of said second elastic member; and (h) a release member mounted on said cover for moving said braking member away from said rotor upon said opening being closed by said cover to release the contact of said braking member with said rotor.

4. A toy top spinner according to claim 2 or 3, wherein said hook means includes a first engagement member for engaging a larger toy top, and a second engagement member for engaging a smaller toy top such that said first engagement member is fixed on said rotor whereas said second engagement member can appear out of and disappear into said rotor.

* * * * *